United States Patent [19]

Cormier

[11] Patent Number: 4,635,930

[45] Date of Patent: Jan. 13, 1987

[54] SAFETY BENCH PRESSING APPARATUS

[76] Inventor: Gary Cormier, 32 S. Central St., Bradford, Mass. 01830

[21] Appl. No.: 759,334

[22] Filed: Jul. 26, 1985

[51] Int. Cl.[4] ..... A63B 13/00

[52] U.S. Cl. ..... 272/123; 272/DIG. 4

[58] Field of Search ..... 272/117, 118, 123, 134, 272/144, DIG. 4

[56] References Cited

U.S. PATENT DOCUMENTS

| | | | |
|---|---|---|---|
| 3,268,224 | 8/1966 | Freshour | 272/123 X |
| 4,231,570 | 11/1980 | Reis | 272/123 |
| 4,302,009 | 11/1981 | Johnson | 272/123 |
| 4,316,609 | 2/1982 | Silberman | 272/123 X |
| 4,368,884 | 1/1983 | Colvin | 272/123 |
| 4,411,425 | 10/1983 | Milnar | 272/123 |

OTHER PUBLICATIONS

Universal Catalog, 1982–1983, p. 5.

*Primary Examiner*—Richard J. Apley
*Assistant Examiner*—John L. Welsh
*Attorney, Agent, or Firm*—Edward A. Gordon

[57] ABSTRACT

The invention is a safety bench press apparatus which prevents injuries as a consequence of a dropping or otherwise uncontrolled impact of the bar bell upon a weight lifter. The apparatus can be installed as an accessory to the weight lifting bench or as an integrated component of the bench. The apparatus comprises two vertical side support members which are disposed on each side of and parallel to the bench press. The upper surface of the support members are configured to provide an inclined portion which inclines upwardly away from the shoulders of the weight lifter (anterior portion of the bench) towards the foot (posterior portion of the bench) and terminates in a holding portion which is provided with a retainer member which functions to hold the bar bell in fixed position when placed in the holding portion. In one embodiment of the invention the vertical support members are provided with retainer members which prevent the bar bell from rolling or sliding off the inclined surfaces. The vertical support members are constructed and arranged to be adjustable with respect width to accommodate weight benches of different widths, and with respect to height to accommodate benches of different heights as well as weight lifters of different body sizes.

13 Claims, 9 Drawing Figures

SAFETY BENCH PRESSING APPARATUS

1. FIELD OF THE INVENTION

This invention relates to a weight lifting apparatus and more specifically to a new and improved apparatus providing a mechanical substitute for the assistance of a "spotter" during an individual's performance of the bench press exercise.

2. DESCRIPTION OF THE PRIOR ART

It is important for a participant in regular bench press exercise to work out at or near his limit (i.e. the most weight that can be lifted in repetition or the most weight lifted once or twice), always attempting to perform more repetitions or adding more weights. Each year more people take up weight lifting. While sporting equipment manufacturers and instructors furnish information explaining to lifters, especially novice lifters, the dangers of lifting alone, many accidents still occur.

In bench pressing, a padded bench, which may be horizontal or inclined, is positioned between the uprights and the support arms carried by the uprights and lowered to a point slightly less than the outstretched grasp of the lifter lying on his back on the bench. To exericse, the lifter grasps the bar, lifts it off the support arms and then raises and lowers it over his chest. Heretofore in bench pressing it has been required that the lifter or exerciser, when working with heavy bar bells, work in the presence of others known as spotters in order to avoid grave injury in the event the lifter exhausts his strength and is unable to return the bar bell to the support arms. Unless, the lifter can call for assistance from spotters to lift the weights, there is nothing the exerciser can do, and if the weights come to rest on his chest, it might be crushed and the lifter seriously if not fatally injured.

A spotter, however, is not always available to the many people who, for one reason or another, perform the exercise alone or at least when a spotter is not at immediate standby attention which is most desirable.

The prior art discloses various safety devices and or mechanical substitutes for spotters.

U.S. Pat. No. 4,411,425 by Milnar discloses two adjustable bar supporting members having V-shaped rests to receive the barbell. The two support members are attached to either side of the bench at a position above the lower chest or the lifter. While the patent provides some safety, it requires that the weight lifter have sufficient strength and control to reach forward and maneuver the barbell into the V-shaped receptacles. In an emergency situation where the lifter has exhausted his strength and is unable to return the barbell, the supports of Milnar would not serve as a substitute for a spotter.

U.S. Pat. No. 4,231,570 by Reis discloses two safety bars which are attached to the upright weight supports and angled down to the side of the bench to prevent the weight lifter from dropping the weights on his chest. The safety bars as disclosed required the weight lifter to position his arms on the outside of the safety bars when lifting the weights which may impede the exercise process. Additionally, when the lifter looses control or suddenly becomes exhausted or cramped, the lifter will have to exert backward pressure to prevent the weights from rolling down the incline and damaging the lower chest or pelvic area.

U.S. Pat. No. 4,368,884 to Colvin discloses a safety device which fits about the upper end of the weight bench and has vertically adjustable members for catching the outer portion of the bar bell. None of the foregoing prior art teaches or suggests the particular weightlifting apparatus of the present invention.

A desirable object of the present invention is to provide a device which permits the weight lifter to exercise with a bar bell by himself and in the event the lifter is unable to return the bar bell to the main supports, provides a mechanical substitute for a spotter thereby allowing relatively greater safety and convenience.

Another desirable object of the present invention is to provide a safety device which serves as an easily installed accessory to, or integrated component of most weight lifting benches.

A still further desirable object of the present invention is to provide a safety device which cooperates with the weight lifting bench to support and maintain the weight lifter firmly upon the bench while in a generally supine position.

A still further desirable objcet of the present invention is to provide a safety device which readily accomodates a range of sizes of weight lifters who may use it especially the vertical adjust requirements which is critical to safety. Other desirable objects and advantages of the present invention will in part appear hereinafter and will in part become apparent after consideration of the specification with reference to the accompanying drawings.

SUMMARY OF THE INVENTION

The invention is a safety bench press apparatus which prevents injuries as a consequence of dropping the bar bells. The device can be installed as an accessory to the weight lifting bench or an an integrated component of the bench. The apparatus comprises two vertical side support members which are disposed on each side of and parallel to the bench press. The upper surface of the support members are configured to provide a surface which inclines upwardly away from the shoulders of the weight lifter (anterior portion of the bench) towards the foot (posterior portion of the bench) and terminates in a holding portion which which is provided with a groove which functions to hold the bar bell in fixed position when placed in the holding portion. The inclined ramp configuration permits unobstructed movement while still providing a support when the lifter is fatigued as well as the ability to pass within the arms of the lifter thereby bringing the support surfaces of the side members closer to the lifting area. When a prospective weight lifter has exerted himself to disabling arm fatigue and the like he merely lowers the bar bell to any point on the supporting inclined surfaces. He does not have to be concerned with maneuvering the bar bell to a limited rest area. Once the bar bell is supported by the inclined surfaces, the lifter can, after resting in that position if required, easily slide the bar bell to the holding portion of the supporting members where the bar bell is held in secure position and easily exit by sliding out from under the bar and off the bench. In a preferred embodiment the vertical side support members are provided with retainer members which are automatically activated by the bar bell thereby preventing the bar bell from rolling or sliding off the inclined surfaces where the lifter is unable to prevent the same. The vertical support members are constructed and arranged to be adjustable with respect width to accomodate weight benches of different widths, and with respect to height to accomodate benches of different heights as well as weight lifters of different body sizes.

BRIEF DESCRIPTION OF THE DRAWINGS

For a fuller understanding of the nature and desired objects of the invention, reference should be had to the following detailed description taken in connection with the accompanying drawings, wherein like reference characters refer to corresponding parts throughout the several views and wherein.

DETAILED DESCRIPTION OF PREFERRED EMBODIMENTS

Figure 1:
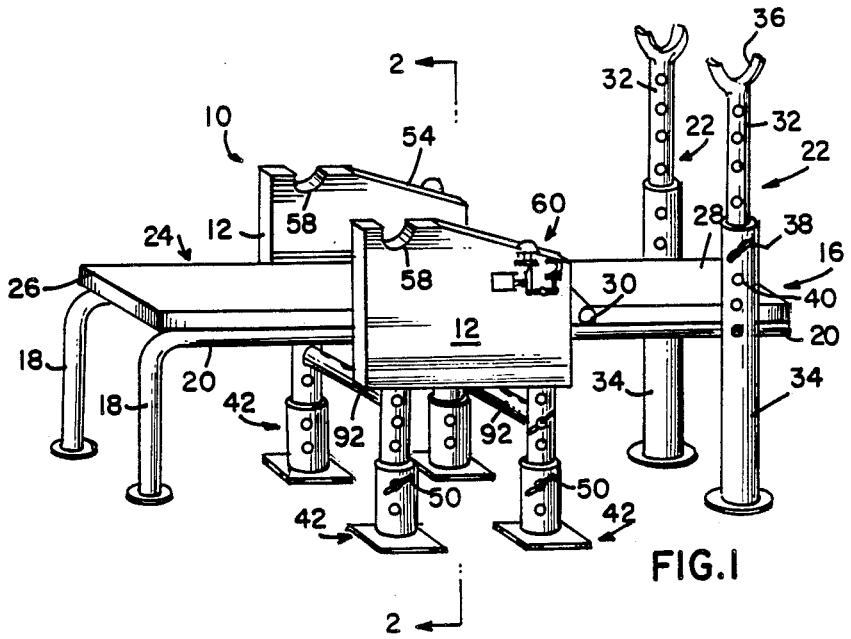
FIG. 1 is a side perspective view of the bench press safety apparatus of the invention attached to a weight lifting bench.
Figure 2:
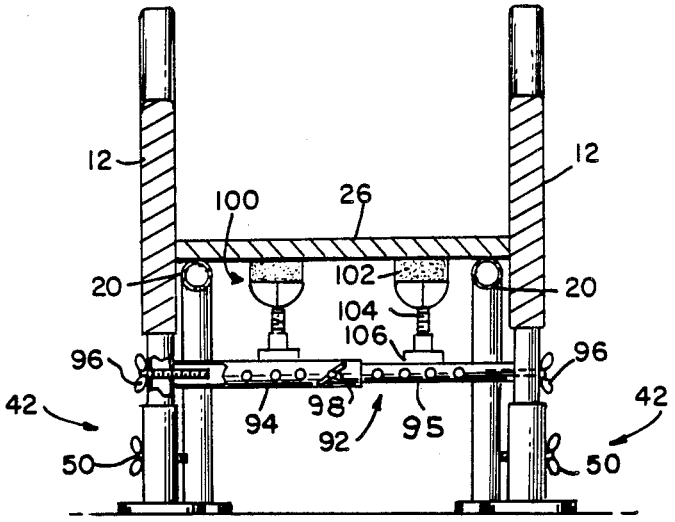
FIG. 2 is a cross sectional view taken along the plane of line 2—2 of FIG. 1.
Figure 3:
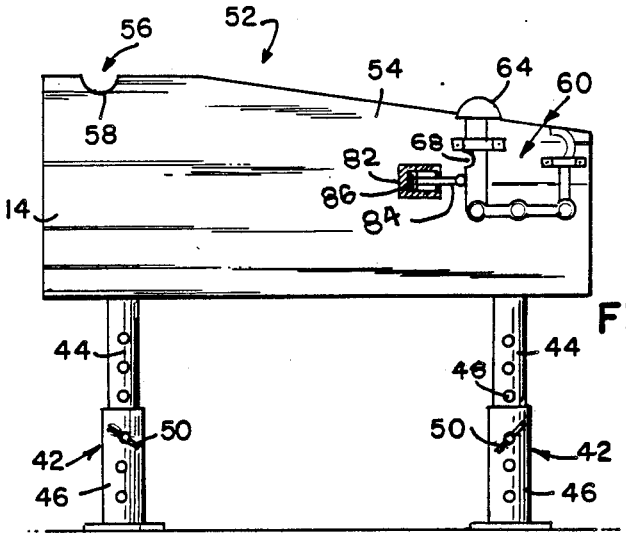
FIG. 3 is an enlarged side perspective view of the bench press safety apparatus of FIG. 1.

Referring now to the drawings of this invention particularly FIGS. 1–3 there is illustrated a safety bench pressing apparatus 10 in accordance with the present invention. The apparatus comprises two vertical side support members 12 which are disposed on each side of and parallel to the longitudinal side of weight bench 16 which is maintained horizontal and in elevation by a pair of support legs 18 at the foot or posterior portion of the bench each having an elongated structural member portions 20 which are securly attachable to adjustable upright bar supporting members 22. Fixed upon the elongated members 20 of the weight bench 16 is board assemble 24 which comprises a pair of boards 26 and 28 which are hingedly joined at 30 in order that board 28 may be elevated. Each of the upright members 22 may be positioned in any one of a plurality of fixed vertical positions by the adjustment of the length of the vertical telescoping members 32 and 34 by adjusting the upper members 32 with respect to the lower members 34 to the desired height of the bar retaining forks 36 or other bar retaining means attached to the upper members 36 and then placing a suitable retaining bolt and wing nut 38, or other suitable retaining means well known to those skilled in the art, in an appropriate hole 40 to cause the bolt to support the upper telescoping member 32 with respect to the lower member 34. Each of the vertical side support members is supported by a pair of adjustable supporting legs 42. As illustrated the supporting legs 42 comprise vertical telescoping members 44 and 46 and holes 48, and which are releasably joined to each other by a suitable means illustrated as bolt and wing nut 50. The supporting legs 42 are adjustable in the same manner as described with respect to the bar support members 22.

Figure 4:
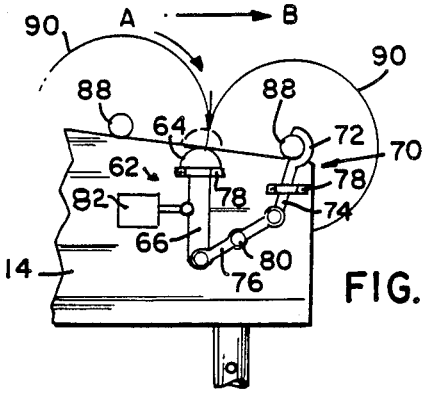
FIG. 4 is a fragmentary view of a portion of FIG. 3 enlarged over the scale of FIG. 3 showing the safety retainer actuation.

The upper surfaces 52 of the support members 12 are configured to provide an inclined portion 54 and a holding portion 56. The inclined portion, inclines when in position, upwardly in a direction moving from the anterior portion of the weight bench toward the posterior portion or in other words inclines upwardly away from the shoulders of the weight lifter when in supine position on the bench. The holding portion 56 is preferably generally horizontal and is provided with suitable means, such as groove 58, for receiving and holding the bar bell (not shown). In the preferred embodiment, the vertical side support members 12 are provided with bar bell retaining means 60 which are automatically actuated by the bar bell should it roll or slide to that portion of the inclined ramp 54. As illustrated, reference being made particularly to FIG. 4, the retaining means 60 comprises an actuating member 62 having a rounded upper head portion 64 and a lower rod portion 66 carrying a detent 68, and a retaining arm 70 having an upper curved portion 72 and a lower rod portion 72. The rods 66 and 74 are pivotally joined to each other by any suitable type of connection such as a pivotal lever arm 76.

The bar bell retaining means may be secured in operating position on the vertical support members 12 and 14 by retaining guard rings 78 and pivotal pin means 80. Positioned adjacent rod 66 is housing 82 which carries pin 84 which is urged forward by tension spring 86 into register with detent 68 when detent is moved into alignment by the downward movement of arm 66 when activated by pressure on head 64, thereby locking the curved retaining member 72 into position to receive and hold the bar 88 of bell 90. In operation, when the weight lifter loses control or suddenly becomes exhausted or cramped and the bar bell is manuvered or dropped, for example, to where the bar 88 of bell 90 contacts the inclined surface, 54 at point A, and the lifter is unable to prevent the bar bell from rolling or sliding off the inclined surface, then as the bar rolls or slides over the activator head 64 it is depressed and concurrently pivotally raises retainer member 72 which arrests the bar bell and prevents contact with the lifter and thereby avoids injury since the bar bell is retained at point B. As best seen in FIG. 2 the vertical support members 12 are held in position adjacent to board 26 by an adjustable transverse means 92 such as for example a pair of horizontal telescoping members 94 and 95, which are attached to the upper leg members 44 by suitable means such as threaded bolts 96. Telescoping members are adjustably secured by wing nut bolt means 98. Positioned on each transverse means 92 are adjustable frictional members 100 which serve to retain the vertical side support members 12 in place in its desired location along the weight bench 16. The frictional members comprise an upper pad 102 formed of rubber or other compressible material, which has sufficient frictional force to retain the safety press apparatus in longitudinal position along the bench 16, a lower threaded portion 104 for adjusting the tension, and a lower threaded member suitably attached to the transverse member 92 such as by welding screws or other means well known to those skilled in the art. Such frictional pads 100 may be disposed on one or both of the transverse members 92.

Figure 5:
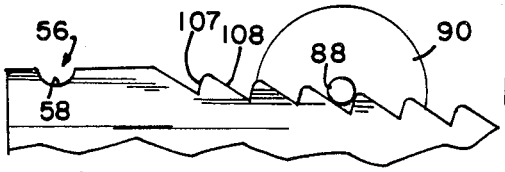
FIG. 5 is a fragmentary side view of a vertical support member of the invention illustrating a modified embodiment of the inclined supporting surface.
Figure 6:
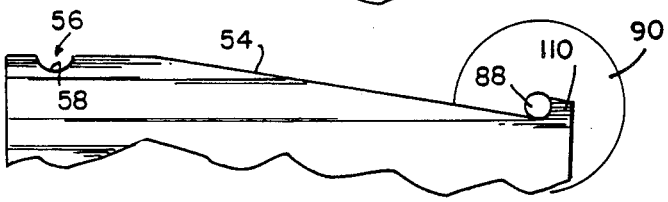
FIG. 6 is a fragmentary side view of a vertical support member of the invention illustrating a further modified embodiment of the inclined supporting surface.

Referring now to FIGS. 5 and 6 there are illustrated modified embodiments of the inclined surface of ramp 54. As illustrated in FIG. 5 the inclined surface is configured to form a plurality of saw-toothed like retaining members 108 which form a plurality of bar bell retaining grooves or slots 107 which extend across the inclined surfaces 54 and serve to retain the bar bell in the receiving grooves 107. As illustrated in FIG. 6 the lower end of the inclined surface 54 is provided with a bar bell retaining means which is a turned up end 110 of the inclined surface.

Figure 7:
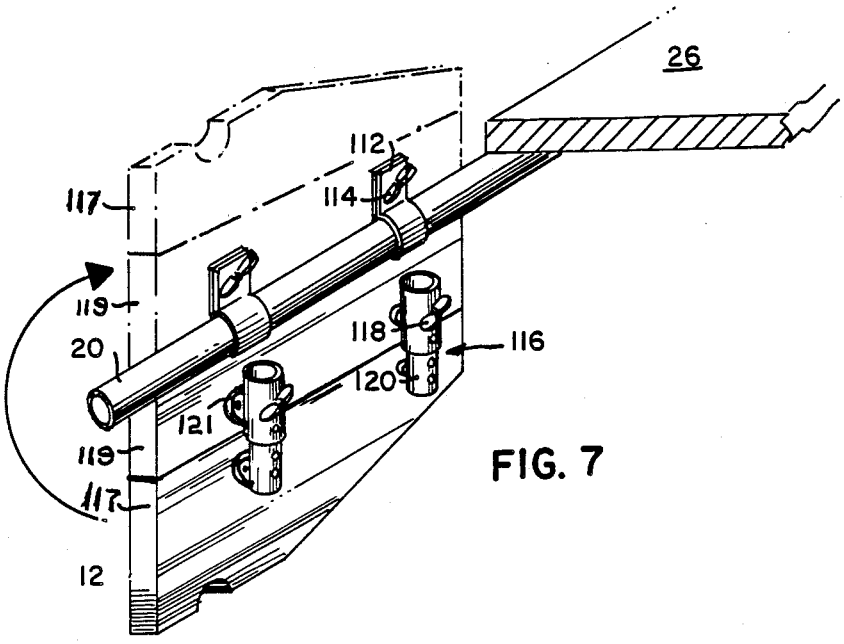
FIG. 7 is a fragmentary side perspective view of a modified embodiment of the invention as integrated with a weight lifting bench.
Figure 8:
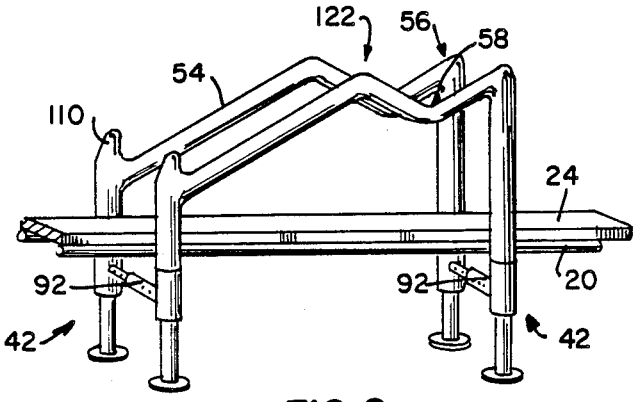
FIG. 8 is a fragmentary side perspective view of a modified embodiment of the invention.
Figure 9:
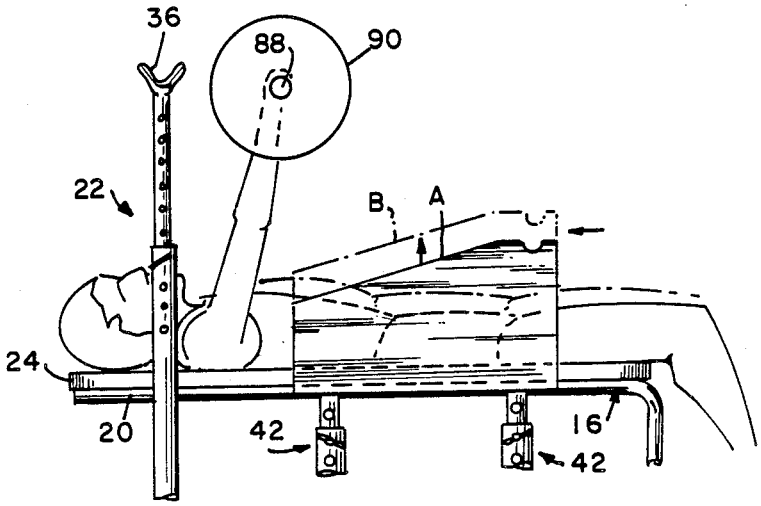
FIG. 9 is a fragmentary side perspective view of the invention attached to an occupied weight lifting bench illustrating the adjustable features.

FIG. 7 illustrates a modified embodiment of the invention wherein the vertical support members such as 12 of FIG. 1 are an integrated component of the weight bench and are provided with an upper member 117 which is vertically adjustable from the lower member 119. In this embodiment the lower member 119 of the vertical support member is attached to the elongated members 20 of the weight bench 16. For simplicity FIG. 7 illustrates one side wherein the vertical support member 12 is attached from its lower member 119 to elongated member 20 by clamp means 112 and bolt and wing nut means 114. Attached to the upper member 117 and lower member 119 of the vertical support member 12 by suitable means such as screws 121 are a pair of adjustable telescoping members 116 which have retaining screws 118 and a plurality of holes 120 which allow a plurality of fixed vertical positions of the upper members 117 relative to the lower member 119 by adjustment of the length of the telescoping members 116. In this manner the vertical support member can be swung into active position (as shown by arrow and dotted lines) moved to the desired longitudinial position on elongated member 20 and secured in position by clamp means 112. The desired vertical height can then be selected and fixed in position by means of telescoping members 116 and retaining screws 118. Referring now to FIG. 8 there is illustrated a modified embodiment of the invention as an accessory safety bench press apparatus. In this embodiment of the invention the vertical side support members 122 are formed of a tubular material, and, as described with respect to support members 12, have an inclined portion 54, a retaining portion 56, groove 58 and a retainer member portion 110. In other respects the supporting legs 42, transverse members 92 and friction members 100 (not shown) are as described herein. With continuing reference to the drawings for operations of the invention, the invention is used in the following manner whether the invention is accessory to the weight bench or as an integrated component of the bench. With particular reference to FIG. 9 the weight lifter and/or an assistant positions the vertical side support members to a suitable longitudinal position along the side of the weight bench 16. Where for example the weight lifter is of slight build (solid line) the vertical support members 12 are positioned at A (solid line) adjacent the lifters shoulders and the vertical height adjusted to protect the lifter's chest. Where the weight lifter is of larger build (dotted line) the vertical support members are raised and moved toward the lifter's shoulders to a position at B (dotted lines) whereby the lifter chest is protected.

An additional feature of the present invention is that the vertical side support members provide lateral support of the weight lifter's body during lifting while in a generally supine position. In the manufacture of the invention various materials such as wood, metals, plastics or combinations thereof may be employed one of the main requirements being to select materials which exhibit the strength and impact resistance corresponding to the weights to be employed.

While the invention has been described with respect to preferred embodiment it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A bench press safety apparatus for use with a weight lifting bench having board means of given width and length with anterior and posterior ends for supporting a weight lifter thereupon in at least a generally supine position along the longitudinal length and main bar bell upright support members located immediately adjacent to said anterior end of said board means, the safety apparatus comprising:

a pair of vertical support members each having an elongated upper surface and a lower surface; and further including;

means associated with the lower surface of said vertical support members for supporting said vertical support members in parallel vertical spaced relationship adjacent opposing longitudinal sides of said board means of said weight lifting bench;

said upper surface of said vertical support members being formed into an inclined portion and a generally horizontal holding portion;

said inclined portion having an upper end and a lower end and being inclined upwardly toward said posterior end of said board means of said weight lifting bench;

said holding portion extending posteriorly of said inclined portion and having means for retaining a bar bell to prevent said bar bell from rolling off said holding portion; and means for adjustably securing said safety apparatus at a fixed point adjacent said board means and said anterior end of said weight lifting bench;

whereby said inclined surfaces is positioned above the chest of said weight lifter for receiving thereupon a falling or otherwise uncontrolled bar bell to prevent such bar bell from impacting upon said weight lifter supine on said board means of said weight lifting bench and allowing said weight lifter to support said barbell from rolling off said inclined surface onto said weight lifter.

2. The bench press safety apparatus of claim 1 wherein said means associated with the lower surface of said vertical support members comprises a pair of leg members generally being secured to the lower surface of said vertical support members.

3. The bench press safety apparatus of claim 2 wherein said leg members include means for vertically adjusting the height of said leg members.

4. The bench press safety apparatus of claim 2 further comprising horizontally disposed transverse members having one end joined to the leg member of one vertical support member and the opposite end joined to the leg member of the other vertical support member;

said transverse members being horizontally adjustable for effecting contacting engagement of said vertical support members with opposing longitudinal sides of said board means.

5. The bench press safety apparatus of claim 4 further comprising frictional means having one end thereof attached to said transverse member, the opposite end having a frictional surface and being engageable with the lower surface of said board means for securing said safety apparatus at a fixed position along the longitudinal length of said board means.

6. The bench press safety apparatus of claim 1 wherein the retaining means of said holding portion of each vertical support member comprises corresponding groove means.

7. The bench press safety apparatus of claim 1 wherein the inclined portion of the upper surface of each vertical support member has a plurality of corresponding grooves for receiving and retaining therein a falling or otherwise uncontrolled bar bell which contacts said inclined portion of said vertical support members.

8. A bench press safety apparatus for use with a weight lifting bench having board means of given length with anterior and posterior ends for supporting a weight lifter thereupon in at least a generally supine position along the longitudinal length and main bar bell upright support members located immediately adjacent to said anterior end of said board means, the safety apparatus comprising:

a pair of vertical support members each having an elongated upper surface and a lower surface;

means associatd with said support members for connecting said support members in parallel vertical spaced relationship on each side of said board means of said weight lifting bench to form a unitary structure;

means associated with said support members for vertically adjusting the height of said upper surface of the support members;

said upper surface of said vertical support members being formed into an inclined portion and a generally horizontal holding portion;

said inclined portion having an upper end and a lower end and being inclined upwardly toward said posterior end of said board means of said weight lifting bench;

said holding portion extending posteriorly of said inclined portion and having means for retaining a bar bell to prevent said bar bell from rolling off said holding portion; and means for retaining the bar bell associated with said inclined portion to prevent the bar bell from rolling off the inclined surface;

said inclined surface being positioned above the chest of said weight lifter for receiving thereupon a falling or otherwise uncontrolled bar bell to prevent such bar bell from impacting upon said weight lifter supine on said board means of said weight lifting bench.

9. The bench press safety apparatus of claim 8 wherein said means for retaining the bar bell associated with said inclined surface comprises:

a retaining member positioned adjacent to the lower end of the inclined portion of each vertical support member and below the upper surface thereof;

an actuating member having an upper portion thereof positioned above said upper surface and a lower portion having a detent means formed therein;

said actuating member being positioned at a point on said inclined portion above said retaining member;

a pin means for locking register with said detent means; and pivotal means connecting said actuating member and said retaining member whereby said bar bell moving over said actuating member depresses said actuating member to locking register with said detent and said pin while concurrently raising said retaining member to arrest further movement of the bar bell and prevent contact with the lifter.

10. A safety bench press apparatus comprising:

a frame means having a pair of spaced horizontal members having anterior and posterior ends; and further including;

a corresponding pair of spaced anterior and posterior uprights associated with said horizontal members;

means associated with said anterior uprights for supporting a bar bell;

board means of a given length supported by said frame means for supporting a weight lifter thereupon in at least a generally supine position;

a pair of vertical support members each having an elongated upper surface and a lower surface; and further including;

means associated with the lower surface of said support members for supporting said vertical support members in parallel spaced relationship adjacent opposing sides of the length of said board means;

said upper surface of said vertical support members being formed into an inclined portion and a generally horizontal holding portion;

said inclined portion being inclined upwardly toward said posterior end of said frame means;

said holding portion extending posteriorly of said inclined portion and having means for retaining said bar bell to prevent said bar bell from rolling off said holding portion; and whereby said inclined surfaces is positioned above the chest of said weight lifter for receiving thereupon a falling or otherwise uncontrolled bar bell to prevent such bar bell from impacting upon said weight lifter supine on said board means and allowing said weight lifter to support said barbell from rowing off said inclined surface on to said weight lifter.

11. The safety bench press apparatus of claim 10 wherein said means for supporting said vertical support members comprise attaching means pivotably and slidably coupled to said spaced horizontal members such that the vertical support members can be swung from an inactive position below said horizontal member to an active position above said horizontal member and slid to a desired position on said horizontal member; and means for releasably securing said attaching means at said desired position.

12. The safety bench press apparatus of claim 11 further including means for vertically adjusting the height of said vertical support members with respect to said board means.

13. A bench press safety apparatus for use with a weight lifting bench having board means of given length with anterior and posterior ends for supporting a weight lifter thereupon in at least a generally supine position along the longitudinal length and main bar bell upright support members located immediately adjacent to said anterior end of said board means, the safety apparatus comprising:

a pair of vertical support members each having an elongated upper surface and a lower surface;

means associated with said support members for connecting said support members in parallel verticle spaced relationship on each side of said board means of said weight lifting bench to form a unitary structure;

means associated with said support members for vertically adjusting the height of said upper surface of the support members;

said upper surface of said vertical support members being formed into an inclined portion and a generally horizontal holding portion;

said inclined portion having an upper end and a lower end and being inclined upwardly toward said posterior end of said board means of said weight lifting bench;

said holding portion extending posteriorly of said inclined portion and having means for retaining said bar bell to prevent said bar bell from rolling off said holding portion;

a retaining member positioned adjacent to the lower end of the inclined portion of each vertical support member and below the upper surface thereof;

an actuating member having an upper portion thereof positioned above said upper surface and a lower portion having a detent means formed therein;

said actuating member being positioned at a point on said inclined portion above said retaining member;

a pin means for locking register with said detent means; and pivotal means connecting said actuating member and said retaining member whereby said bar bell moving over said actuating member depresses said actuating member to locking register with said detent and said pin while concurrently raising said retaining member to arrest further movement of the bar bell and prevent contact with the lifter.

* * * * *